United States Patent [19]

Hefling

[11] Patent Number: 4,870,314

[45] Date of Patent: Sep. 26, 1989

[54] CAM-ACTUATED PIEZOELECTRIC IGNITION DEVICE FOR GAS APPLIANCE

[75] Inventor: Dennis V. Hefling, Wichita, Kans.

[73] Assignee: The Coleman Company, Inc., Wichita, Kans.

[21] Appl. No.: 123,715

[22] Filed: Nov. 23, 1987

[51] Int. Cl.[4] ..... H01L 41/08

[52] U.S. Cl. ..... 310/339; 126/39 E; 431/255

[58] Field of Search ..... 310/338, 339; 361/260; 126/39 E; 315/209 PZ; 431/123, 129–132, 255, 256, 264, 277

[56] References Cited

U.S. PATENT DOCUMENTS

| | | | |
|---|---|---|---|
| 3,428,408 | 2/1969 | Ameyama et al. | 310/339 X |
| 3,434,790 | 3/1969 | Kanda | 310/339 X |
| 3,466,474 | 9/1969 | Ochiai | 310/339 |
| 3,676,041 | 7/1972 | Mobus | 431/255 X |
| 3,676,047 | 7/1972 | Soma | 431/255 |
| 3,770,363 | 11/1973 | Friedrich | 431/255 X |
| 3,963,411 | 6/1976 | Challet | 126/39 E X |
| 4,025,288 | 5/1977 | Plozner | 431/255 |
| 4,273,529 | 6/1981 | Nakahara | 431/255 |
| 4,302,181 | 11/1981 | Schlosser | 310/339 X |
| 4,691,136 | 9/1987 | Schmidt | 310/339 |

FOREIGN PATENT DOCUMENTS

| | | | |
|---|---|---|---|
| 2804048 | 8/1979 | Fed. Rep. of Germany | 310/339 |

*Primary Examiner*—Mark O. Budd

[57] ABSTRACT

A gas appliance such as a propane lantern is provided with a piezoelectric ignition device which is operated by the on-off control knob of the appliance. The piezoelectric ignition device is actuated by a pushbutton. The control knob includes a cam which causes movement of the pushbutton as the control knob rotates.

9 Claims, 4 Drawing Sheets

FIG. 1
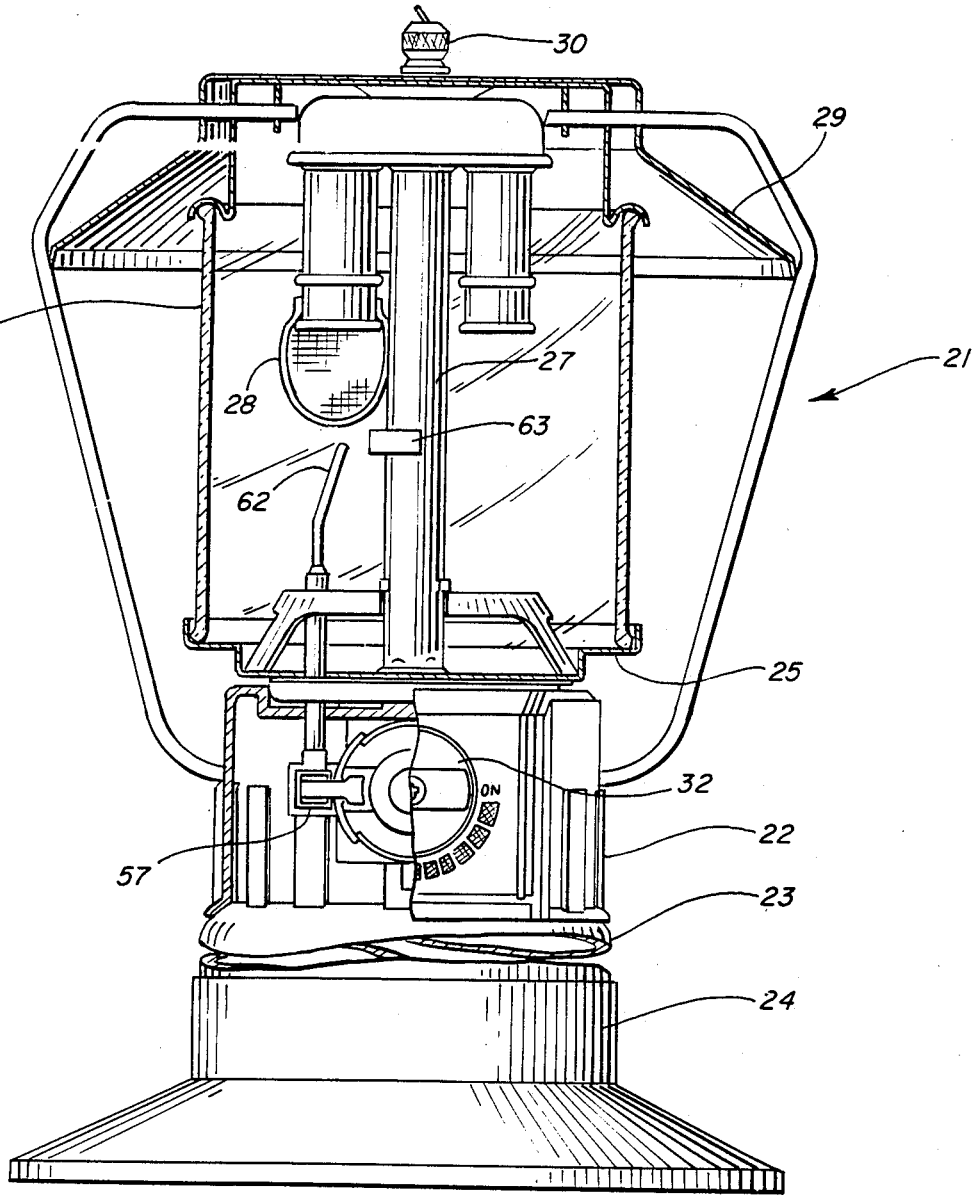
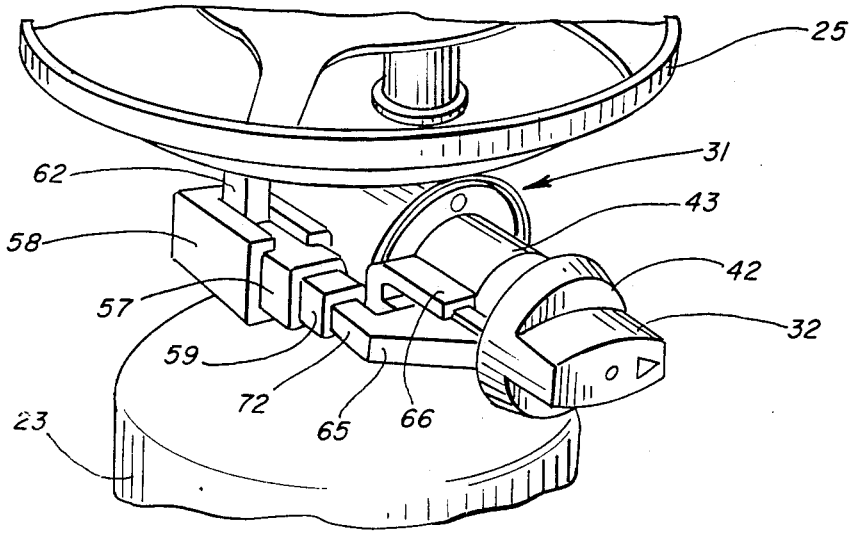
FIG. 2

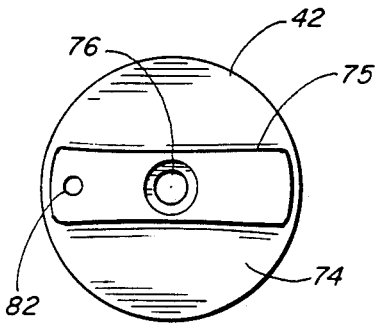
FIG. 15
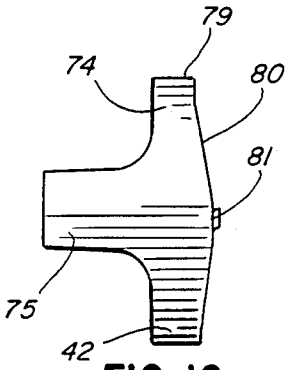
FIG. 16
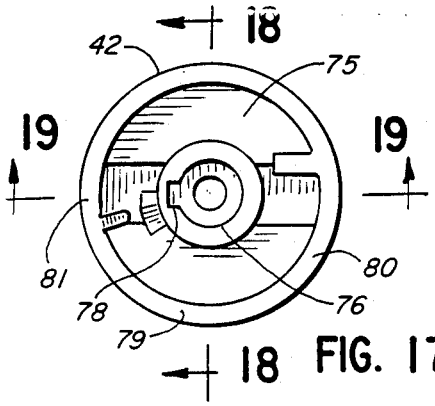
FIG. 17
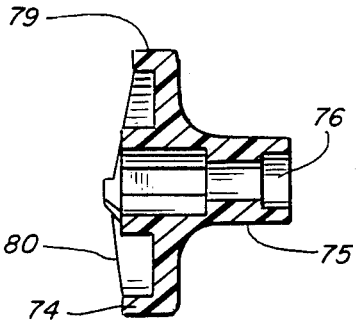
FIG. 18
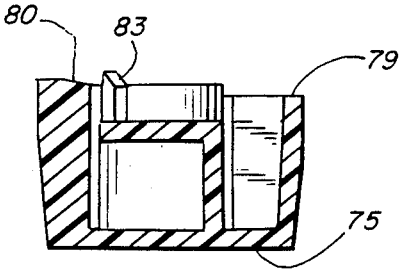
FIG. 19
FIG. 20
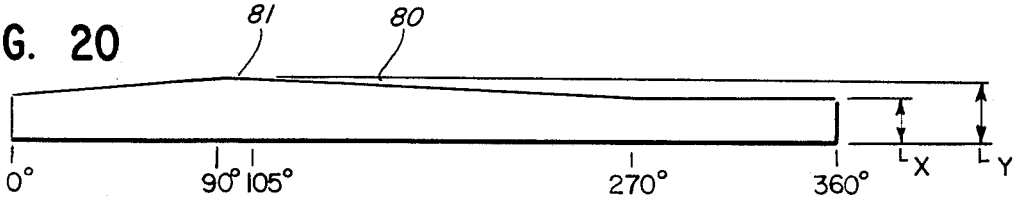
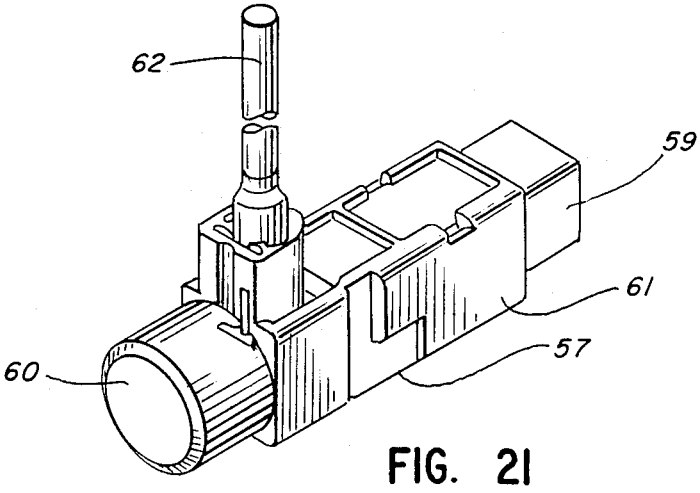
FIG. 21

CAM-ACTUATED PIEZOELECTRIC IGNITION DEVICE FOR GAS APPLIANCE

BACKGROUND

This invention relates to piezoelectric ignition devices for gas appliances such as propane lanterns and gas barbecue grills. More particularly, the invention relates to a piezoelectric ignition device which is operated by the on-off control knob of the gas valve of the appliance.

Piezoelectric ignition devices are commonly used for igniting propane lanterns, barbecue grills, etc. A piezoelectric ignition device generally includes a piezoelectric crystal, an impact hammer for striking the crystal, and an electrode for conducting voltage from the crystal to the point of ignition. The outer end of the electrode is spaced from a grounded conductor. The piezoelectric crystal generates a voltage when it is impacted by the hammer, and propane or other fuel is ignited when the piezoelectric electrode arcs to ground.

U.S. Pat. No. 4,691,136 describes a typical piezoelectric ignition device for a gas appliance. The piezoelectric ignition device described in the patent is actuated by a cam knob which is rotatably mounted on the appliance. Rotation of the cam knob moves a spring-loaded hammer away from the piezoelectric crystal and then releases the hammer. The gas valve of the appliance is operated by a separate control knob, and rotation of the cam knob must be coordinated with rotation of the control knob.

I am aware of a Japanese gas stove which uses a control knob attached to a butane regulator to turn the gas on and to activate a piezoelectric ignitor when the regulator reaches the full open position. The knob engages a trip mechanism which moves tangentially with respect to the knob to actuate the ignitor.

SUMMARY OF THE INVENTION

The invention provides an actuating assembly which causes the actuator of the piezoelectric ignitor to move in a direction which is parallel to the axis of rotation of the control knob. The control knob includes a shaft which is rotatably mounted within a shaft housing, and a cam in the housing moves the shaft axially as the shaft rotates. The control knob also includes a camming ramp which is engageable with a cam follower which is slidably mounted on the appliance between the control knob and the ignitor. As the control knob rotates, the axial movement of the shaft and the knob and the cam action of the camming ramp of the knob causes the cam follower to move axially relative to the control knob to actuate the ignitor.

DESCRIPTION OF THE DRAWING

The invention will be explained in conjunction with an illustrative embodiment shown in the accompanying drawing, in which FIG. 1 is an elevational view, partially broken away, of a propane lantern equipped with a piezoelectric ignition device in accordance with the invention;

FIG. 2 is a fragmentary perspective view of the gas regulator and ignition device of the lantern;

FIG. 15 is an end elevational view of the finger knob;

FIG. 16 is a side elevational view of the finger knob;

FIG. 17 is a rear elevational view of the finger knob;

FIG. 18 is a sectional view taken along the line 18—18 of FIG. 17;

FIG. 19 is a sectional view taken along the line 19—19 of FIG. 17;

FIG. 20 is an illustration of the camming ramp of the finger knob; and

FIG. 21 is a fragmentary perspective view of the piezoelectric ignition device.

DESCRIPTION OF SPECIFIC EMBODIMENT

The invention will be explained in conjunction with a propane lantern 21 illustrated in FIG. 1. It will be understood, however, that the invention can be used with any device which is equipped with a piezoelectric ignition device. The lantern 21 is conventional except for the piezoelectric ignition device, and a detailed explanation of the lantern is unnecessary.

Figure 3:
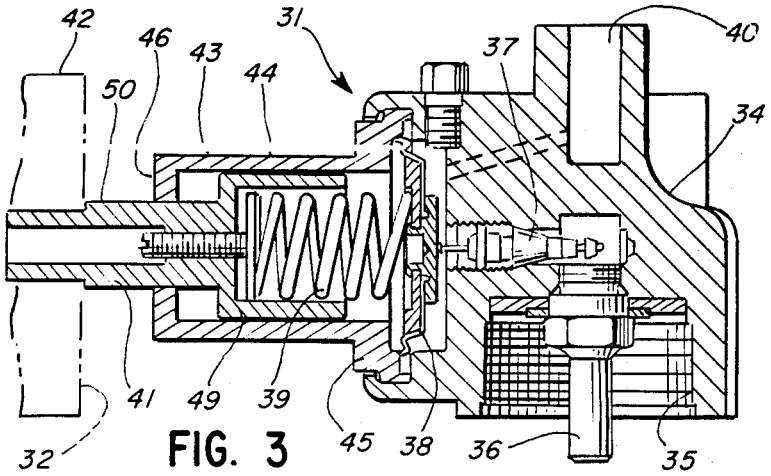
FIG. 3 is a fragmentary sectional view of the gas regulator.

The lantern includes a base or frame 22 which is supported by a propane tank 23, and the tank is mounted in a support collar 24. A dish-shaped pan 25 is mounted on the base 22 and supports a cylindrical globe 26. A burner assembly 27 extends upwardly within the globe and conducts fuel from the propane tank 23 to a catalytic mantle 28. A ventilator cover 29 is mounted on top of the globe and is secured to the burner assembly by a knot 30. Fuel flow is controlled by a regulator assembly 31 (FIG. 3) in the base of the lantern, and the regulator assembly is operated by a rotatable control knob 32.

The regulator assembly 31 is also conventional and need not be explained in detail. The particular regulator assembly is used on propane lanterns and other propane appliances which are manufactured by The Coleman Company, Inc. of Wichita, Kans.

The regulator assembly includes a regulator body 34 which is provided with an internally threaded bore 35 for connecting the regulator to the propane tank 23. A probe 36 extends downwardly within the bore for opening the valve in the propane tank.

A valve 37 in the regulator housing is operated by a diaphragm 38. The diaphragm 38 is moved toward or away from the valve 37 by a coil spring 39 and the control knob 32. Movement of the diaphragm toward the valve opens the valve and allows gas to flow to the bore 40 which is connected to the burner assembly 27.

Figure 9:
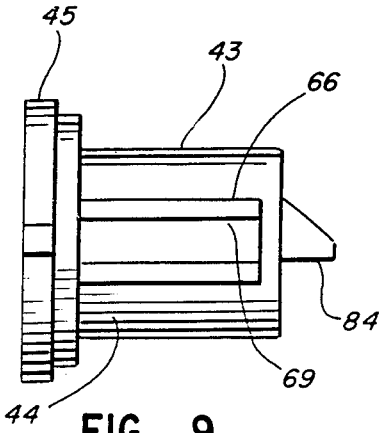
FIG. 9 is a side elevational view of the housing for the shaft of the control knob.
Figure 10:
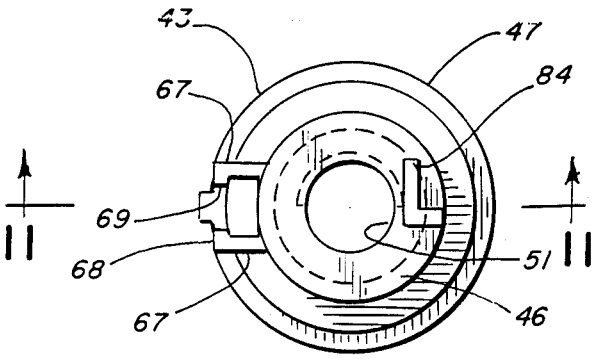
FIG. 10 is an end elevational view of the housing of FIG. 9.
Figure 11:
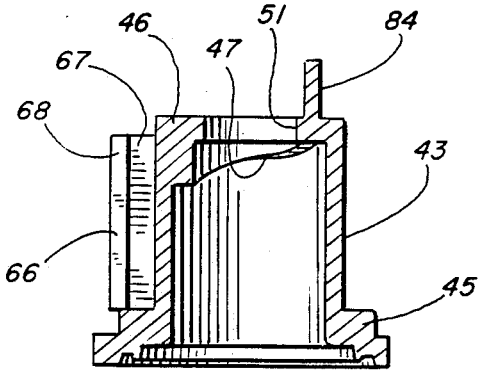
FIG. 11 is a sectional view taken along the line 11—11 of FIG. 9.

The control knob 32 includes a shaft 41 and a finger knob 42 which is secured to the end of the shaft. The shaft 41 is rotatable within a shaft housing 43 which is secured to the regulator body 34. The shaft housing includes a cylindrical side wall 44, a radially outwardly extending inner end flange 45 which is secured within the regulator body 34, and an annular outer end wall 46 (see also FIGS. 9–11). An annular camming ramp 47 (FIGS. 11 and 12) extends axially from the outer end wall 46 toward the inner end flange 45.

Figure 7:
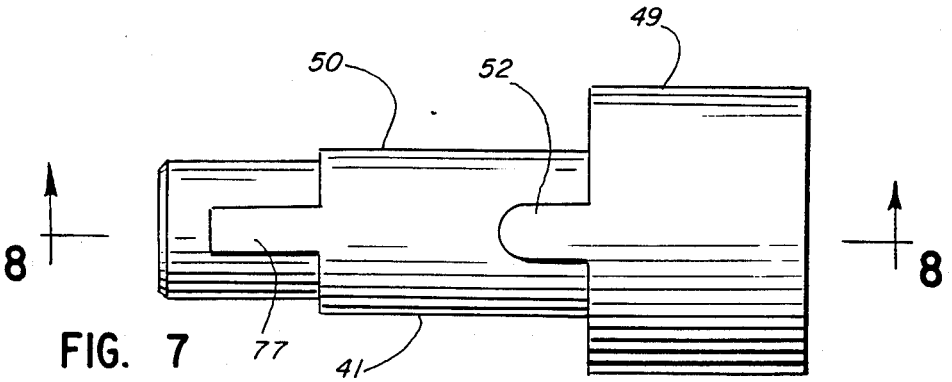
FIG. 7 is an elevational view of the shaft of the control knob.
Figure 8:
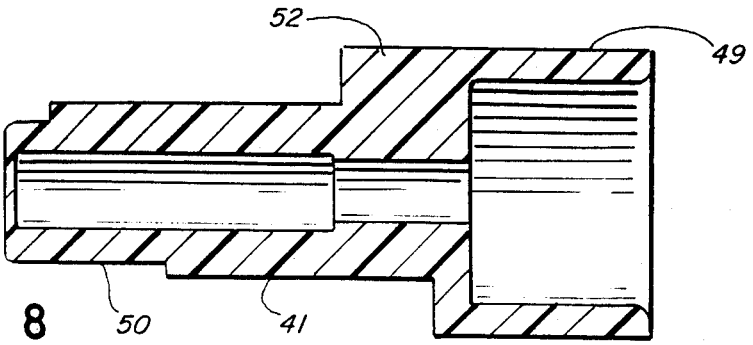
FIG. 8 is a sectional view taken along the line 8—8 of FIG. 7.

The control knob shaft 41 includes a cylindrical inner end portion 49 which rotates within the cylindrical side wall 44 of the shaft housing 43 and an outer end portion 50 which extends through an opening 51 in the outer end wall 46 of the housing 43. A cam engager 52 (FIGS. 7 and 8) extends axially from the cylindrical end portion 49 along the outer end portion 50. The cam engager 52 engages the camming ramp 47 of the shaft housing 43, and the control knob shaft 40 is thereby moved axially toward the diaphragm 38 of the gas valve as the shaft is rotated clockwise. Axial movement of the control knob shaft toward the diaphragm causes the spring 39 to depress the diaphragm and open the valve 37.

Figure 12:
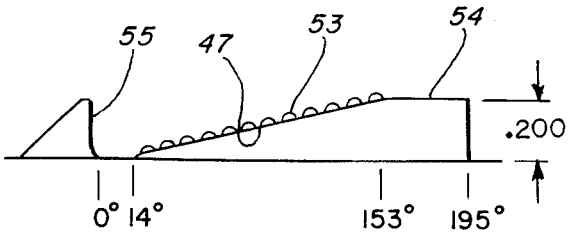
FIG. 12 illustrates the camming ramp of the housing shown in FIG. 11.

Referring to FIG. 12, the camming ramp 47 is provided with 16 detent bumps 53 for retaining the cam engager 52 at a desired position along the ramp. The ramp terminates in a flat end portion 54. A stop wall 55 on the housing 43 is spaced from the other end of the ramp.

The off position of the control knob is indicated at 0° in FIG. 12. During the first 14° of rotation of the control knob, the control knob does not move axially. During the next 139° of rotation, the camming ramp moves the control knob 0.200 inch axially. The valve reaches the full on position when the control knob is rotated 153°, and the control knob does not move axially as the cam engager 52 moves along the end portion 54 between 153° and 195°.

Figure 4:
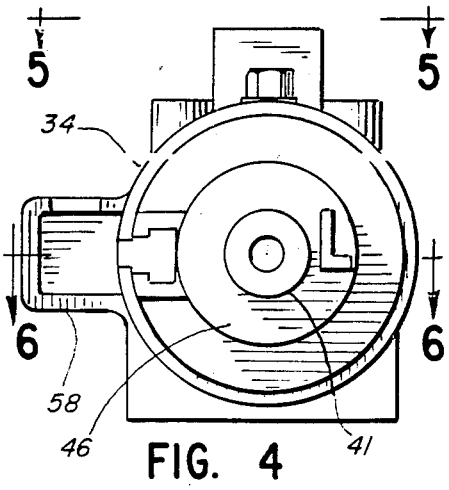
FIG. 4 is an elevational view of the gas regulator.
Figure 5:
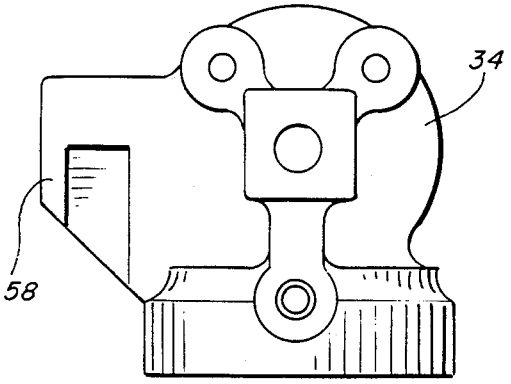
FIG. 5 is a top plan view of the gas regulator taken along the line 5—5 of FIG. 4.
Figure 6:
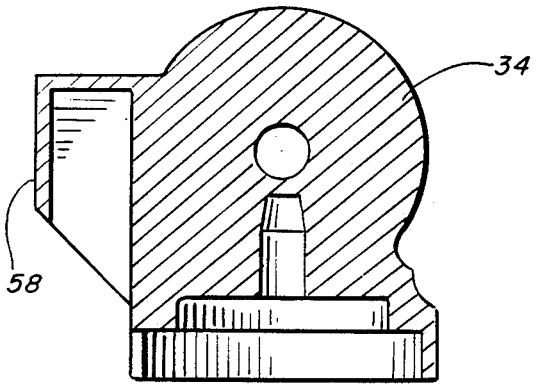
FIG. 6 is a sectional view of the gas regulator taken along the line 6—6 of FIG. 4.

A piezoelectric ignition device 57 (FIGS. 2 and 21) is mounted within a rectangular sleeve 58 on the valve housing 34 (see also FIGS. 4–6). The piezoelectric ignition device is a conventional device of the type which is operated by a pushbutton 59. The particular ignition device illustrated is Model PSS9 from Rion Electric Corp. and Rion Trading Co.

The piezoelectric ignition device 57 includes a piezoelectric crystal 60 which is secured to a pushbutton housing 61. The pushbutton 59 is slidably mounted within the housing 61. An electrode 62 is connected to the piezoelectric crystal. The upper end of the electrode terminates adjacent a metal ignitor tab 63 (FIG. 1) which is mounted on the burner assembly 27 adjacent one of the gas mantles 28.

The ignition device is operated by pushing the pushbutton 59 toward the crystal 60. A spring-biased hammer within the housing is released after the pushbutton is moved toward the crystal a predetermined distance. When the hammer strikes the piezoelectric crystal, voltage is conducted from the crystal by the electrode 62 and arcs to the ignitor tab 63, thereby igniting the propane gas which is delivered to the mantles 28 by the burner assembly 27.

Figure 13:
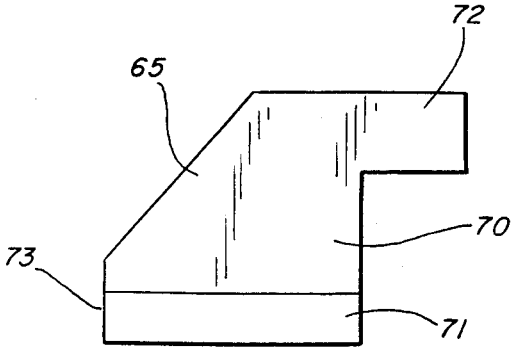
FIG. 13 is a side elevational view of the cam follower.
Figure 14:
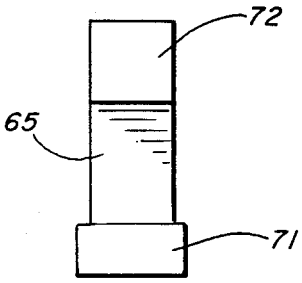
FIG. 14 is an end elevational view of the cam follower.

The pushbutton 59 is moved by a cam follower 65 which is slidably mounted within a channel 66 (FIGS. 9–11) on the shaft housing 43. The channel includes a pair of side walls 67 and a pair of top walls 68 which are spaced apart to provide a slot 69. Referring to FIGS. 13 and 14, the cam following 65 includes a generally triangular body portion 70, an enlarged base portion 71, and a pushbutton engaging projection 72 and cam-engaging end 73. The base 71 slides within the channel 66 and is retained therein by the top walls 68.

Referring to FIGS. 15–19, the finger knob 42 includes a circular base portion 74 and a rectangular gripping portion 75. The finger knob is secured to the control knob shaft 43 by a screw which extends through a bore 76 in the finger knob. The knob and shaft are secured against relative rotation by a key 77 on the shaft which is inserted into a key way 78 in the bore 75.

An annular rim 79 extends axially from the periphery of the base portion 74 toward the gas valve. The rim 79 is provided with a camming surface 80 which engages the end 73 on the cam follower 65. The contour of the camming surface 80 is illustrated in FIG. 20. The portion of the camming surface indicated at 0° is at 12 o'clock in FIG. 17. The high portion 81 of the camming surface which is indicated at 90° is at 9 o'clock in FIG. 17.

The off position of the finger knob 42 is illustrated in FIG. 15. An indicator 82 on the knob is positioned at 9 o'clock. The gas valve is turned on by rotating the knob clockwise. As the knob 42 and the shaft 41 rotate, the camming surface 47 (FIG. 11) within the housing 43 moves the knob and shaft axially and opens the valve 37. Referring to FIG. 12, the valve is fully opened after the knob rotates 153°, and further rotation of the knob does not cause any further axial movement.

The axial movement of the finger knob 42 caused by the camming surface 47 moves the cam follower 65 and the pushbutton 59 of the piezoelectric ignition device toward the piezoelectric crystal. However, in the embodiment illustrated, this axial movement is not sufficient to release the hammer of the ignition device. The additional movement of the cam follower and the pushbutton which is required to release the hammer is provided by the camming surface 80 of the finger knob 42.

Referring to FIGS. 15–20, when the finger knob 42 is rotated 153° from the off position illustrated, the high point 81 of the camming surface 80 will be just below the 9 o'clock position and will be adjacent the cam follower 65. Further rotation of the knob will cause the high point 81 to engage the cam follower, thereby moving the cam follower and pushbutton 59 sufficiently to release the hammer and actuate the ignition device. This additional rotation of the finger knob occurs after the valve 37 is fully opened. The valve can therefore be operated by the control knob after ignition without actuating the ignition device. A stop finger 83 (FIG. 19) on the finger knob is engageable with a stop 84 (FIGS. 10 and 11) on the housing 43 after the pushbutton of the ignition device is depressed sufficiently to release the hammer.

The lantern is operated by rotating the finger knob 42 clockwise from the off position illustrated in FIG. 15 until the stop finger on the finger knob engages the stop 84 on the housing 43. The initial rotation of the finger knob will open the gas valve to permit gas to flow to the mantle 28, and the final portion of the rotational movement of the finger knob will actuate the ignition device to ignite the gas at the mantles. The lantern is therefore turned on and ignited with a single rotational movement of the control knob. After the gas is ignited, the finger knob is rotated counterclockwise to adjust the flame.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A control knob and ignition assembly for a gas appliance having a frame, a gas burner mounted on the frame, and a gas valve mounted on the frame for supplying gas to the burner, the control knob and ignition assembly comprising:

a control knob rotatably mounted on the gas valve for opening and closing the valve, a piezoelectric ignition assembly mounted on the frame and including a housing, a piezoelectric crystal within the housing, and a pushbutton slidably mounted on the housing for movement in a direction which extends parallel to the axis of rotation of the control knob, and cam means on the control knob for moving the push button as the control knob rotates.

2. The structure of claim 1 in which the cam means includes a camming ramp on the control knob which is inclined toward the pushbutton.

3. The structure of claim 2 including a control knob housing mounted on the gas valve, the control knob being rotatable within the control knob housing, said cam means further including a camming ramp within the control knob housing and a cam engager on the control knob engageable with the camming ramp for moving the control knob along the axis of rotation as the control knob rotates.

4. The structure of claim 1 including a control knob housing mounted on the gas valve, the control knob being rotatable within the control knob housing, said cam means including a camming ramp within the control knob housing and a cam engager on the control knob engageable with the camming ramp for moving the control knob along its axis of rotation as the control knob rotates.

5. The structure of claim 4 including a cam follower slidably mounted on the frame between the pushbutton and the cam means for moving the pushbutton as the control knob rotates.

6. The structure of claim 2 including a cam follower slidably mounted on the frame between the pushbutton and the cam means for moving the pushbutton as the control knob rotates.

7. The structure of claim 1 including a cam follower slidably mounted on the frame between the pushbutton and the cam means for moving the pushbutton as the control knob rotates.

8. The structure of claim 1 in which the control knob includes a shaft portion rotatably mounted on the gas valve and a generally circular knob portion secured to the shaft and having a rim, said cam means including a camming ramp on the rim which is inclined toward the pushbutton.

9. The structure of claim 8 including a control knob housing mounted on the gas valve, the shaft portion of the control knob being rotatable within the control knob housing, said cam means further including a camming ramp within the control knob housing and a cam engager on the shaft portion of the control knob which is engageable with the camming ramp for moving the control knob along the axis of rotation as the control knob rotates along its axis of rotation as the control knob rotates.

* * * * *